US008268128B2

(12) United States Patent
Henderson et al.

(10) Patent No.: US 8,268,128 B2
(45) Date of Patent: Sep. 18, 2012

(54) SECURITY SUBSTRATES

(75) Inventors: Peter McLean Henderson, Somerset (GB); Christian David Paul Clark, Wotton-Under-Edge (GB)

(73) Assignee: De la Rue International Limited, Jays Close, De la Rue House, Basingstoke, Hampshire (GB)

( * ) Notice: Subject to any disclaimer, the term of this patent is extended or adjusted under 35 U.S.C. 154(b) by 0 days.

(21) Appl. No.: 12/936,104

(22) PCT Filed: Mar. 27, 2009

(86) PCT No.: PCT/GB2009/000837

§ 371 (c)(1),
(2), (4) Date: Nov. 2, 2010

(87) PCT Pub. No.: WO2009/122155

PCT Pub. Date: Oct. 8, 2009

(65) Prior Publication Data

US 2011/0042025 A1 Feb. 24, 2011

(30) Foreign Application Priority Data

Apr. 1, 2008 (GB) ..... 0805916.4

(51) Int. Cl.
*D21F 11/00* (2006.01)

(52) U.S. Cl. ..... 162/140

(58) Field of Classification Search ..... 162/140; 283/85, 83, 94, 91; 428/156; 427/250
See application file for complete search history.

(56) References Cited

FOREIGN PATENT DOCUMENTS

| | | | |
|---|---|---|---|
| CA | 2122528 | A1 | 4/1994 |
| EP | 0059056 | A1 | 9/1982 |
| EP | 1141480 | A0 | 7/2000 |
| WO | WO 00/39391 | A1 | 7/2000 |
| WO | WO 03/095188 | A2 | 11/2003 |
| WO | WO 04/001130 | A1 | 12/2003 |
| WO | WO 2004/050990 | * | 6/2004 |
| WO | WO 2005106601 | A2 | 11/2005 |
| WO | WO 2006/095161 | A2 | 9/2006 |

* cited by examiner

*Primary Examiner* — Mark Halpern
(74) *Attorney, Agent, or Firm* — GableGotwals

(57) ABSTRACT

The invention is directed toward improvements in security substrates, such as paper, used for making security documents, such as bank notes, having anti-counterfeit able features and in particular to security substrates incorporating an elongate security element and methods of making the substrate. The invention comprises a security substrate for making security documents and the like comprising a fibrous base substrate and an elongate security element at least partially embedded therein. At one surface of the security substrate one portion of the security element is exposed to provide a continuous track along the length of the security element. A plurality of other portions along at least one edge of the security element are partially covered by overlapping regions of the fibrous substrate. The invention further comprises a method of manufacturing such a security substrate.

14 Claims, 4 Drawing Sheets

SECURITY SUBSTRATES

CROSS-REFERENCE TO PENDING APPLICATIONS

This application is a 371 of PCT/GB2009/000837 filed on 27 Mar. 2009, which claims priority to British Patent Application No. 0805916.4 filed 1 Apr. 2008, both of which are incorporated herein by reference.

The invention relates to improvements in security substrates, such as paper, used for making security documents, such as bank notes, having anti-counterfeitable features and in particular to security substrates incorporating an elongate security element and methods of making said substrate.

It is generally known to include elongate security elements in paper or other substrates, usually as a security feature. Such elements can be threads, strips or ribbons of, for example, plastics film, metal foil, metallised plastic, metal wire. These elongate security elements are included in the thickness of the substrate to render imitation of documents produced therefrom more difficult. These elements help in the verification of the documents as they render the view of the documents in reflected light different from that in transmitted light. To increase the security provided by the inclusion of such an elongate security element, it is also known to endow the element itself with one or more verifiable properties over and above its presence or absence. Such additional properties include magnetic properties, electrical conductivities, the ability to absorb x-rays, fluorescence, optically variable effects and thermochromic behaviour.

As a further security feature, it has been found to be particularly advantageous to provide windows in one side of the surface of the substrate, which expose such elongate security elements at spaced locations. Examples of methods of manufacturing paper incorporating security elements with or without windows are described below. It should be noted that references to "windowed thread paper" include windowed paper incorporating any elongate security element.

EP-A-0059056 describes a method of manufacture of windowed thread paper on a cylinder mould papermaking machine. The technique involves embossing the cylinder mould cover to form raised regions and bringing an impermeable elongate security element into contact with the raised regions of the mould cover, prior to the contact entry point into a vat of aqueous paper stock. Where the impermeable security element makes intimate contact with the raised regions of the embossing, no fibre deposition can occur and windows are formed in the surface of the paper. After the paper is fully formed and couched from the cylinder mould cover, water is extracted from the wet fibre mat and the paper is passed through a drying process. In the finished paper the regions of the security element which are exposed in the windows are visible in reflected light on one side of the paper, which is commonly used for mainly banknotes. This method, however, can only be used for narrower elements otherwise a number of manufacturing problems, such as bursting of the bridges, can occur.

The widespread use of security documents having security elements exposed on windows along the length of the element has resulted in enhanced security. A security document of this type provides this enhancement as, when viewed in transmitted light, the security element provides a different view from that which is seen under reflected light, where parts of the security element are readily visible in the window. However, there is a continual need for further enhanced security features to render the task of a would be counterfeiter more difficult.

In Canadian patent specification CA-A-2122528 there is described an anti-falsification paper which incorporates a wide impermeable elongate security thread with a width between 2 mm and 4 mm. The paper is of multi-ply design, with at least two paper layers produced on separate paper machines. The elongate security thread is embedded in a first ply and has perforations along the edges which permit water drainage and hence paper fibre deposition along the edges of the thread. The elongate security thread is laid down over raised areas on the embossed cylinder mould cover before the raised areas enter the vat of paper stock so as to create windows of exposed elongate security thread in the contact regions. The width of the raised areas is narrower than the elongate security thread width to permit permeation through the perforations of the elongate security thread by paper fibres. However, the width of the elongate security thread is so great that the paper formed on the back of the paper has flaws in the form of arbitrary holes in the region of the elongate security thread. A second ply of ordinary paper is independently formed and the two are laminated together and further processed, the second ply thereby covering the flaws in the back of the first ply and providing at least one homogenous paper surface.

In another embodiment, a third ply is laminated over the front of the first ply to wholly embed the elongate security thread. In yet another embodiment, the width of the elongate security thread is selected to be so wide that no paper forms on the back of the first paper ply to provide a continuous exposed area. The elongate security thread may be laid on a continuous raised area on the mould cover before the raised areas enter the vat of paper stock to provide a continuous exposed area on the front of the first paper ply. A second ply of paper is then laminated to the first ply to form the finished security paper and give a homogenous paper layer on one side and a continuous exposed elongate security thread on the other.

WO-A-0039391, on the other hand, describes a method of making single ply paper having a wide elongate impermeable strip at least partially embedded therein on a papermaking machine having a porous support surface of which selected areas are blinded with an impermeable material. A first layer of paper fibres is deposited onto the support surface around the blinded areas and then the elongate strip is introduced so that it lies in contact with the blinded areas. The strip is wider than the blinded areas, so that it overhangs. A further layer of paper fibres is deposited over the first layer and the impermeable strip to securely embed the edges of the strip within the paper. A plurality of discrete translucent or transparent windows is thus formed in one surface of the paper in which the strip is exposed and substantially no paper fibres are deposited on the opposite side along the length of the strip so that a continuous length of the strip is exposed.

WO-A-03095188 also describes a method of manufacturing paper incorporating a wide elongate security element having regions of exposed in windows in the surface of the sheet. To enable wide elements to be incorporated using a similar method as that described in EP-A-0059056, a leading edge of the spaced window forming portions must be at an angle, in the plane of the sheet, other than 90° to the machine direction. As a result the manufacturing problems associated with embedding wide threads are resolved.

However, there is a continual drive to improve security substrates incorporating windowed threads and security elements. In particular it is desirable to maximise the visibility of the thread, whilst simultaneously visibly integrating the thread, into the substrate by revealing the fibrous nature of the overlapping substrate and to improve the adhesion of the thread in the substrate whilst maximising its visibility.

It is an object of the present invention to provide an improved security substrate and methods of making such substrate which overcome these problems.

The invention therefore provides a security substrate for making security documents and the like comprising a fibrous base substrate and an elongate security element at least partially embedded therein, wherein at one surface of the security substrate one portion of the security element is exposed to provide a continuous track along the length of the security element, and a plurality of other portions along at least one edge of the security element are partially covered by overlapping regions of the fibrous substrate.

The invention further provides method of manufacturing a security substrate comprising a fibrous base substrate and an elongate security element at least partially embedded therein having at least on exposed region and a plurality of regions along at least one edge of the security element which are covered by areas of substrate, comprising the steps of providing selected areas of a porous support surface with a plurality of raised regions, bringing the security element to overlie the raised regions before depositing fibres on the support surface to form the fibrous substrate, wherein said raised regions having a shape and configuration of which is selected to enable substrate to form in the plurality of regions overlapping the at least one edge of the security element and leaving at least one other region of the elongate security element exposed.

The raised regions may comprise a plurality of window forming regions interlinked with a plurality of narrower connecting regions which form a continuous raised area.

Alternatively the raised regions comprise a plurality of window forming regions of a height which prevents substrate forming across the full width of the security element thereby leaving the at least one other region of the elongate security element exposed.

The invention further provides a method of manufacturing a security substrate comprising a fibrous base substrate and an elongate security element at least partially embedded therein having at least on exposed region and a plurality of regions along at least one edge of the security element which are covered by areas of substrate, comprising the steps of providing selected areas of a porous support surface with a plurality of discrete raised window forming regions, bringing the security element to overlie the raised regions before depositing fibres on the support surface to form the fibrous substrate and subsequently splitting bridges formed between windows in the substrate to provide at least one region of the elongate security element exposed, said one region being narrower than the windows.

As well as overcoming the aforementioned problems, the substrate of the present invention further provides a strong hinge feature for a security substrate used to make security documents that also serves as a highly visible security feature.

There will now be described, by way of example only, with reference to the accompanying drawings preferred embodiments of the present invention in which:—

FIG. 1*a* is a cross sectional side elevation of a schematic representation of a section of a cylinder mould papermaking machine used in the manufacture of a substrate according to the present invention;

FIG. 1*b* is a plan view of a section of a cylinder mould cover for use in the machine of FIG. 1;

Figure 2:
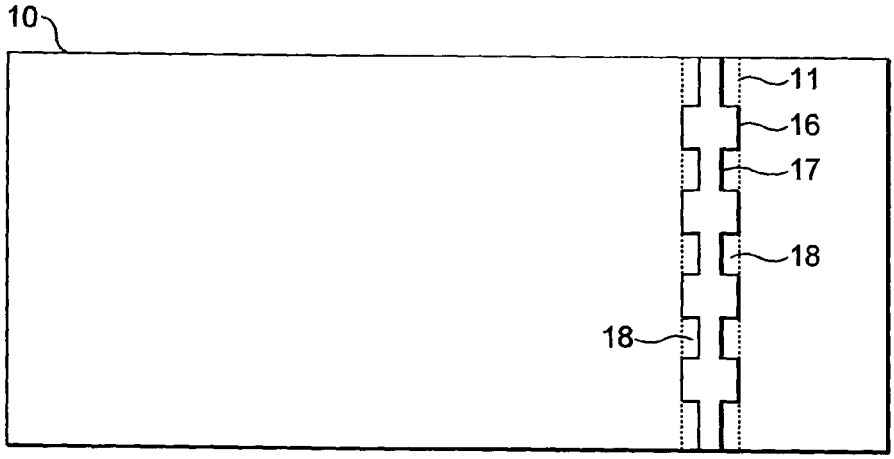
FIG. 2 is a plan view of a sheet made from the substrate of the present invention.
Figure 5A:
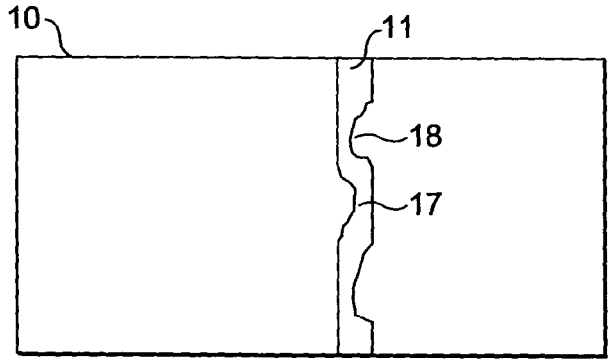
Figure 5B:
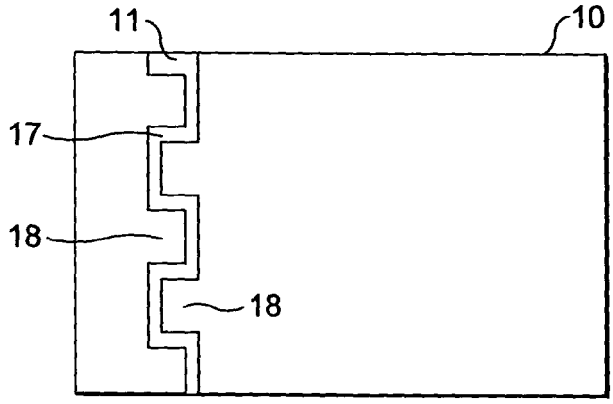
Figure 5C:
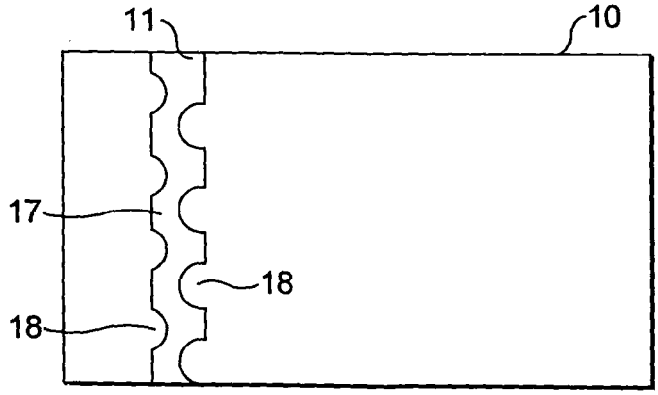
Figure 5D:
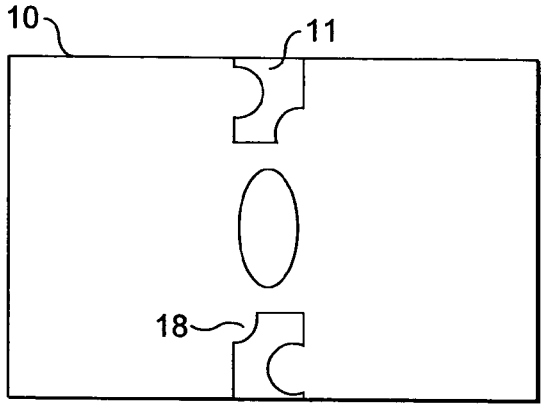
Figure 5E:
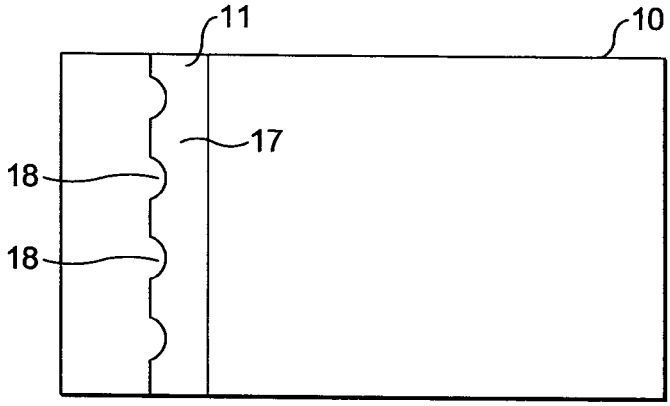
Figure 6:
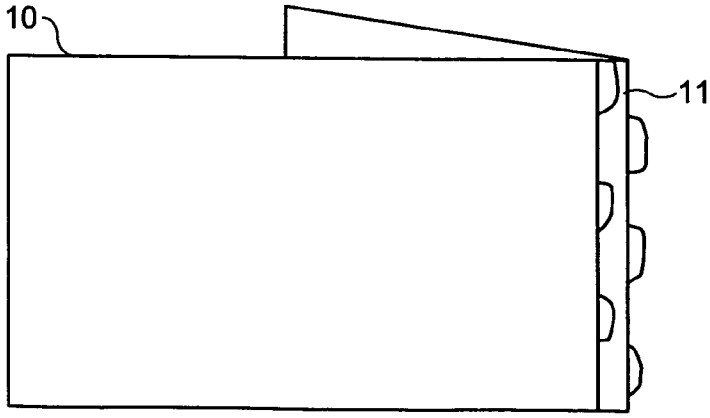

FIGS. 5*a* to 5*e* are plan views of further alternate sheets to that of FIG. 2 made from the substrate of the present invention; and FIG. 6 is a pictorial view of the sheet of FIG. 5*c* folded along the security element.

The security substrate of the present invention can be used to make a variety of security documents and has the following combination of distinctive characteristics which provide good visual and anticounterfeitable features:

(i) a partially embedded elongate security element, a continuous portion of which is exposed along the length of the substrate. This is clearly visible in reflected light and, if the security element is metallised provides a continuous metal path which can easily be machine verified; and (ii) a plurality of discrete regions of substrate overlapping at least one long edge of the elongate security element, which thus appears to be non-continuous when viewed in reflected light from the surface of the substrate. When viewed in transmission, both straight edges of the security element 11 can be seen.

The substrate of the present invention is typically manufactured as a continuous web using a known papermaking machine, such as a cylinder mould or Fourdrinier machine. The web is subsequently cut to form individual smaller sheets 10 (see FIG. 2). The individual smaller sheets 10 are used to form security documents such as banknotes, passports identification cards and the like. A range of fibre types can be used in the making of such substrates, commonly paper, including synthetic or natural fibres or a mixture of both. The actual preparation of the fibres is unrestricted by the invention, and will depend on what effect it is wished to produce in the finished substrate. Security paper used for security documents, such as banknotes, passports, identification cards and so on, needs to be hard wearing, resilient and self-supporting and so an appropriate fibre mix must be selected.

Figure 1A:
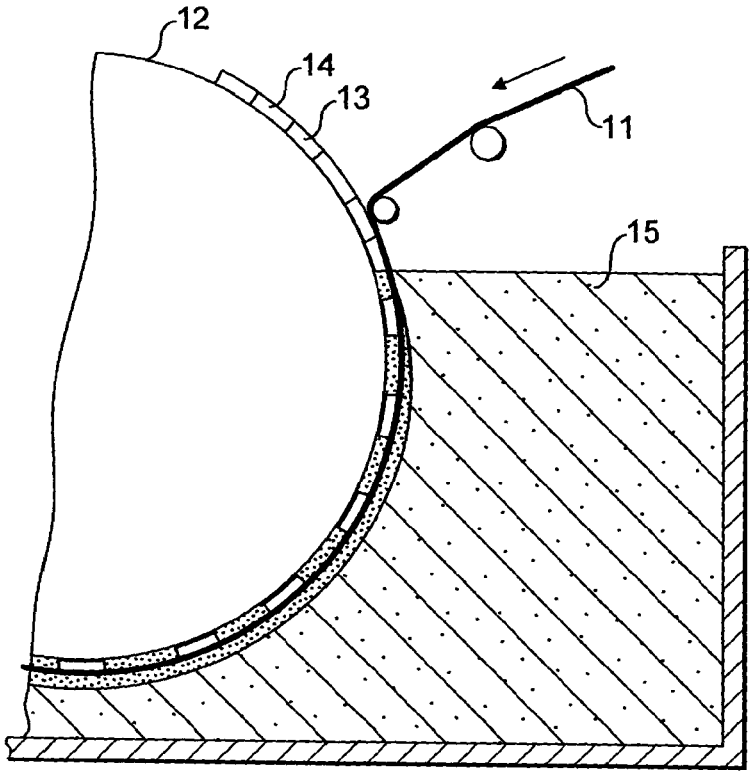

One suitable method of manufacturing the substrate, schematically illustrated in FIG. 1*a*, uses a cylinder mould papermaking machine. The elongate security element 11 is incorporated into the fibrous substrate in a similar manner to that described in EP-A-0059056. Typical security elements 11 have a base carrier of a suitable plastic material and which is flexible and water impermeable, which is at least translucent and partially light transmissive, but preferably substantially transparent. A suitable material for the base carrier would be PET (Polyethylene terephthalate). The carrier is preferably metallised to form a metal layer of aluminum or another suitable metal. This can be done by vacuum deposition, electroplating or another suitable method. The metallised carrier film may be partially demetallised using a known method, such as the resist and etch technique, to leave a series of metallic regions separated by demetallised gaps forming indicia.

Figure 1B:
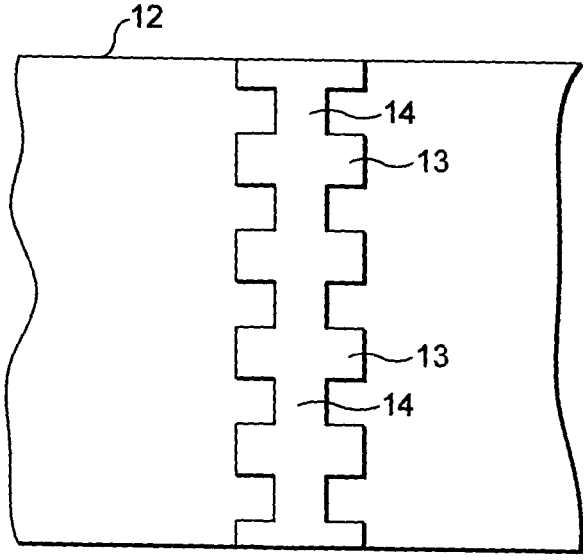

The wire-cloth of the cylinder mould cover 12, which provides a support surface for the formation of the substrate, (see FIGS. 1*a* and 1*b*) is embossed with a series of raised window forming regions 13 which form windows 16 in the finished substrate as described in EP-A-0059056. The raised window forming regions 13 can be rectangular, chevron or any desired shape. Additional raised connecting strips 14 are embossed between the raised window forming regions 13 such that there is a continuous raised section down the centre of the embossing 13,14 (see FIG. 1*b*).

The height of the raised window forming regions 13 above the unembossed cylinder mould cover 12 is preferably in the range 0.8 mm to 1.2 mm as is well known in the prior art windowing methods.

The security element 11 is brought into contact with the embossing 13,14 prior to the entry of the cylinder mould cover 12 into the vat 15 of slurry as with a conventional windowing security element. The security element 11 preferably has a constant width which is greater than 2 mm, and which is greater than the width of the connecting strips 14, but less than the width of the raised window forming regions 13.

In the finished substrate the security element 11 is exposed in windows 16 corresponding to the shape of the raised window forming regions 13, with a continuous portion 17 of the security element 11 exposed along the length of the security element 11 (see FIG. 2) where the security element 11 overlay the connecting strips 14. Substrate is formed in intermittent regions 18 overlapping the edges of the elongate security element 11 between the windows where the fibres encroach. This occurs because the raised connecting strips 14 are narrower than the raised window forming regions 13.

Figure 3:
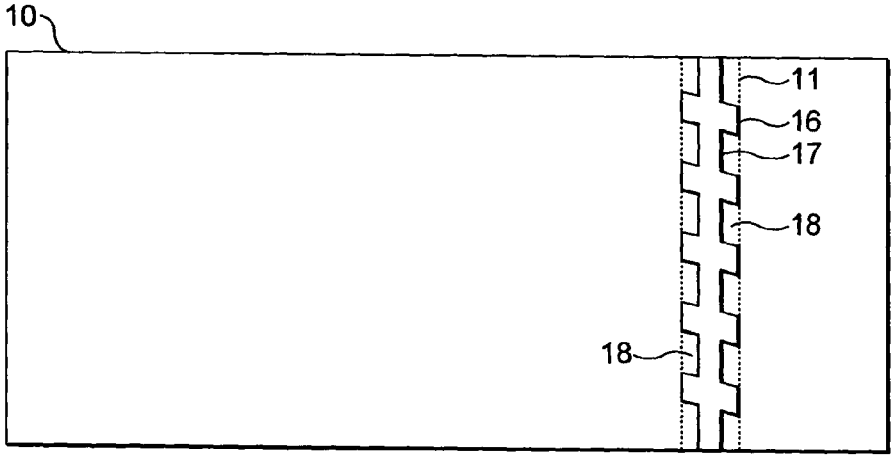
FIG. 3 is a plan view of an alternate sheet to that of FIG. 2 made from the substrate of the present invention.

The windows 16 in the substrate of the present invention may be of any shape and FIG. 3 illustrates an example utilizing chevron shaped windows 16 which are known from WO-A-03095188. This is a preferred form of windows 16 for the present invention because the shape of the windows 16 aids with dewatering during the manufacturing process and allows the fibres to form over the non-windowing side of the elongate security element 11. During the manufacturing process, as each bridge (the area between the windows 16) is passed through the press section of the machine, only a part of the bridge is actually in the nip at any one time. The consequence of this is that water squeezed out of the substrate in the nip migrates to the non-bridge area and is channeled harmlessly away along these angled windows 16 of the elongate security element 11, instead of being forced along through the bridges.

Figure 4:
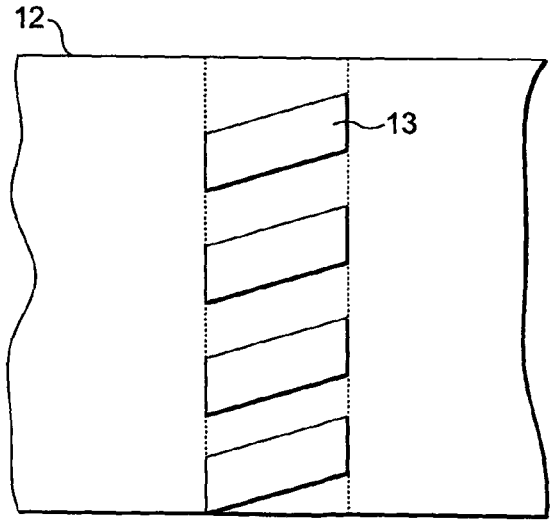
FIG. 4 is a plan view of a section of an alternate cylinder mould cover to that of FIG. 1*b* for use in the machine of FIG. 1.

In a second suitable method of making a substrate according to the present invention, the elongate security element 11 is incorporated into a fibrous substrate in a similar manner to that described in EP-A-0059056 or WO-A-03095188 with a suitable configuration of raised window forming regions 13. Unlike in the method described above, the wire-cloth of the cylinder mould cover 12 is only embossed to provide the raised window forming regions 13 (see FIG. 4). In this particular embodiment the resulting windows 16 are chevron in shape (as in FIG. 3) although other shapes can be used. The difference between this and the prior art methods is that the height of the window forming regions 13 is reduced from that of a conventional windowing configuration such the height of the embossing is less than 0.8 mm and preferably in the range 0.2 mm to 0.6 mm.

A wide elongate security element 11 (i.e. having a width greater than 2 mm) is then brought into contact with the raised regions 13 prior to the cylinder mould cover 12 entering the vat 15 as with the conventional methods of embedding a windowing security element. However, in the substrate of the present invention, whilst the elongate security element 11 is exposed in the windows 16, the height of the raised window forming regions 13 is sufficiently low that it is not possible for the fibrous stock to flow around the elongate security element 11, in the regions between the raised window forming regions 13, which is necessary for the formation of complete substrate area on the windowing side of the elongate security element 11. Instead fibres are deposited at a plurality of limited regions 18 which overlap the edges of the elongate security element 11 between the windows 16. As in the previously described method, this also leaves a continuous central exposed portion 17 of elongate security element 11 (as in FIG. 3). It should be noted that FIG. 3 is a schematic representation only and the amount of substrate in the overlapping regions 18 formed between the windows 16 will not be regular as the encroachment of fibres is different in different regions of the elongate security element 11.

In a third suitable method of forming a substrate according to the invention, the elongate security element 11 is incorporated as described in EP-A-0059056 or WO-A-03095188 and the bridges between the windows 16 are deliberately split by either an air jet, a fine water jet or mechanical abrasion, to form the continuous exposed portion 17 of the security element 11.

Preferably total width of the overlap regions 18 formed by fibre encroachment is greater than 0.5 mm across the width of the element 11, preferably more than 1 mm, even more preferably more than 2 mm, and even more preferably still more than 3 mm. The overlapping regions 18 may be on one or both edges of the elongate security element 11 and the measure of fibre encroachment is a sum of the encroachment from both sides (i.e. an encroachment of 0.5 mm could be 0.25 mm from each side, 0.5 mm from one side only, or any other combination that sums to 0.5 mm).

Examples of different configurations of the overlap regions 18 are shown in FIGS. 5*a* to 5*d*. It can be seen that the exposed region 17 may be linear or non-linear, central or non-central, and that the overlapping regions 18 may be regular or irregular and of a variety of different configurations. The methods used in the present invention can also be used to make a security substrate which is similar to those described above, but in which the exposed region 17 is not continuous, although continuity is preferred.

An important advantage of the present invention is that the noticeable encroachment of fibres in the intermittent overlap regions 18 along the elongate security element 11 illustrates to the authenticator the relationship between the fibrous substrate and the elongate security element 11. Furthermore if the substrate is bent around the elongate security element 11 and if no adhesive is placed on the top side of the security element 11, the partial bridges resulting from the incomplete fibre encroachment will detach from the security element 11 and become a highly visible and difficult to counterfeit feature. This is illustrated in FIG. 6.

This invention is only relevant to wide security elements 11 which are typically over 2 mm wide, and preferably greater than 4 mm wide, and even more preferably greater than 5 mm wide.

The elongate security element 11 can advantageously be used as an information carrier and/or can contain a wide variety of known security features including those described in EP-A-0059056, EP-A-1141480 and WO-A-2004001130 and the following:—

- a metallic layer, indicia or designs, which appear dark, when the substrate is viewed in transmitted light, compared to the lighter, partly light-transmitting, substrate. When viewed in reflected light, the shiny metallic parts will be clearly seen in the windows;
- de-metallised indicia or designs, which may comprise areas of substantially removed metal to take advantage of the transparency of the base film and provide a large area of transparent window;
- holographic or diffractive designs, which may comprise areas of full metal and half-tone screens to provide partial transparency and/or no metal;
- front to back print registration, in which features are printed which would clearly exhibit Moiré patterns from both front and back if a counterfeit were attempted.

Alternatively, such patterns could be produced on a transparent film prior to insertion of the element 11 into the paper as a security feature itself. The exact reproduction of such patterns are very difficult to mimic;

luminescent, iridescent, thermochromic, liquid crystal, photonic crystal, or magnetic materials;

designs or indicia created by printed inks;

dichroic materials which can have different colours when viewed in transmission and refection, for example as described in GB-A-1552853. These materials are particularly useful where the windows 14*a*, 14*b* on the front and back of the substrate 10 coincide to form an aperture;

thin film interference devices, as described in EP-A-227423 or liquid crystal polymer films or liquid crystal pigmented inks, such as described in EP-A-435029;

optically variable devices comprising non-holographic micro-optical structures such as arrays of microlenses and arrays of microprisms as described in WO 2005106601 A2 and WO 2006095161 A2.

The invention claimed is:

1. A security substrate for making security documents comprising a fibrous base substrate and an elongate security element at least partially embedded therein, wherein at one surface of the security substrate a first portion of the security element is exposed to provide a continuous track along the length of the security element, and a second portions of the security element along at least one edge of the security element are partially covered by overlapping regions of the fibrous substrate.

2. The security substrate as claimed in claim 1 in which the security element has a width greater than 2 mm.

3. The security substrate as claimed in claim 2 in which the width of the security element is greater than 4 mm.

4. The security substrate as claimed in claim 3 in which the width of the security element is greater than 5 mm.

5. The security substrate as claimed in claim 1 in which the overlapping regions of the fibrous substrate are formed along each edge of the security element.

6. The security substrate as claimed in claim 1 in which the total width of the overlapping regions is more than 0.5 mm.

7. The security substrate as claimed in claim 6 in which the total width of the overlapping regions is more than 1 mm.

8. The security substrate as claimed in claim 7 in which the total width of the overlapping regions is more than 2 mm from the edge of the security element.

9. The security substrate as claimed in claim 8 in which the overlapping regions extend more than 3 mm from the edge of the security element.

10. The security substrate as claimed in claim 1 in which the continuous track of exposed security element is linear.

11. The security substrate as claimed in claim 1 in which the continuous track of exposed security element is non-linear.

12. The security substrate as claimed in claim 1 in which adhesive is applied to the security element so that the overlapping regions of the fibrous substrate adhere to the security element.

13. The security substrate as claimed in claim 1 in which the overlapping regions of the fibrous substrate do not adhere to the security element.

14. The security substrate as claimed in claim 1 in which the security element comprises at least one security feature.

* * * * *